US009630632B2

(12) United States Patent
Wada

(10) Patent No.: US 9,630,632 B2
(45) Date of Patent: Apr. 25, 2017

(54) ARTICLE CONVEYING SYSTEM AND OVERHEAD CARRIER

(71) Applicant: DAIFUKU CO., LTD., Osaka-shi, Osaka (JP)

(72) Inventor: Yoshinari Wada, Shiga (JP)

(73) Assignee: DAIFUKU CO., LTD., Osaka (JP)

( * ) Notice: Subject to any disclaimer, the term of this patent is extended or adjusted under 35 U.S.C. 154(b) by 156 days.

(21) Appl. No.: 14/643,177

(22) Filed: Mar. 10, 2015

(65) Prior Publication Data

US 2015/0284011 A1 Oct. 8, 2015

(30) Foreign Application Priority Data

Apr. 7, 2014 (JP) ..... 2014-078280

(51) Int. Cl.
*B61B 3/02* (2006.01)
*B61C 13/04* (2006.01)

(52) U.S. Cl.
CPC ..... *B61B 3/02* (2013.01); *B61C 13/04* (2013.01)

(58) Field of Classification Search
CPC .. B61B 3/02; B61B 5/02; B61B 13/00; B61B 15/00; B61B 3/00; B61B 5/00; B61C 13/04; B61C 15/02; E01B 25/00; E01B 25/12; E01B 7/00; E01B 25/26; E01B 25/28; B62D 1/265; B65G 2201/0297; B60L 2200/26
USPC ..... 104/94, 130.07; 105/155
See application file for complete search history.

(56) References Cited

U.S. PATENT DOCUMENTS

| | | | | |
|---|---|---|---|---|
| 7,107,911 | B2 * | 9/2006 | Suh | B61B 3/02 104/91 |
| 8,146,506 | B2 * | 4/2012 | Stahn | B61B 1/00 104/130.07 |
| 8,950,337 | B1 * | 2/2015 | Davis | E01B 25/00 104/124 |
| 2005/0139114 | A1 * | 6/2005 | Nakao | B61B 13/04 104/96 |
| 2013/0061772 | A1 | 3/2013 | Chen et al. | 104/91 |

FOREIGN PATENT DOCUMENTS

| | | | |
|---|---|---|---|
| JP | S54-55906 | 5/1979 | B61D 15/00 |
| JP | 2008-044400 | 2/2008 | B61B 13/00 |
| JP | 2010-247685 | 11/2010 | B61B 13/00 |
| JP | 2011-105254 | 6/2011 | B61B 13/06 |

OTHER PUBLICATIONS

Office Action issued in related Japanese Patent Application No. 2014-078280 dated Nov. 11, 2016 (English-language machine translation provided).

* cited by examiner

*Primary Examiner* — Mark Le
(74) *Attorney, Agent, or Firm* — Kusner & Jaffe

(57) ABSTRACT

An overhead carrier for transporting an article on a ceiling of an article conveying system can travel on curves with various curvatures so as to increase the layout flexibility of traveling rails. Driving wheels that move an overhead carrier along traveling rails and non-driving wheels that are rotated separately from the driving wheels are provided on the right and left of the transport direction of the overhead carrier. In a linear section, the driving wheels on the right and left sides are supported by the traveling rails. In a curved section, the inner non-driving wheel is supported by the inner traveling rail while the outer driving wheel is supported by the outer traveling rail.

6 Claims, 6 Drawing Sheets

ARTICLE CONVEYING SYSTEM AND OVERHEAD CARRIER

FIELD OF THE INVENTION

The present invention relates to an article conveying system that transports articles by means of overhead carriers traveling along a transport track provided near the ceiling of a facility, and relates to the overhead carriers of the article conveying system.

BACKGROUND OF THE INVENTION

An article conveying system used in a production facility of semiconductor devices is sometimes configured such that carriers (overhead carriers) traveling along transport tracks (traveling rails) provided near the ceiling of the facility carry suspended articles (such as magazines, FOUPs, or cases that accommodate multiple semiconductor wafers or semiconductor devices during production) so as to transport the articles along the transport tracks.

A typical overhead carrier used in such an article conveying system has wheels (driving wheels) on the right and left of a vehicle body, for allowing the overhead carrier to travel on a pair of right and left traveling rails. In many cases, an axle for transmitting a rotary force to the right and left driving wheels is shared by the right and left wheels. In this case, a traveling distance of the driving wheels is different between the right and left driving wheels (turning radius differentials arise) in a curved section of the transport track, that is, a section where the traveling rails are curved. Thus, the posture of the overhead carrier is laterally deviated from the traveling direction of the curved section in the case that the overhead carrier travels as in a linear section. In order to prevent the overhead carrier from being caught and stopped in the curved section or falling from the traveling rails in the worst case, measures have to be taken against turning radius differentials, for example, an adjustment to the number of revolutions of the right and left driving wheels by means of a differential gear.

However, in addition to a control unit etc. for suspension of articles, the provision of complicated mechanisms such as a differential gear for making a difference in the number of revolutions between the right and left driving wheels may excessively increase the size of the overhead carrier. This may require a large transportation space and increase the manufacturing cost of the overhead carrier.

Against this backdrop, in an invention described in Japanese Patent Laid-Open No. 2008-044400, the driving wheel of a carrier includes a large-diameter portion and a small-diameter portion. The small-diameter portion in a curved section comes into contact with a traveling rail on the inner track, whereas the large-diameter portion in the curved section comes into contact with a traveling rail on the outer track. Thus, the right and left driving wheels driven with a common drive shaft can smoothly travel in the curved section without using mechanisms such as a differential gear.

Unfortunately, the carrier described in Japanese Patent Laid-Open No. 2008-044400 can only respond to a curve with a radius of curvature corresponding to the diameter ratio between the large-diameter portion and the small-diameter portion.

In other words, even if the carrier can smoothly travel along a curve with a specific radius of curvature, the carrier may have a turning radius differential along a curve with other radius of curvature, leading to unsmooth traveling. This limits a radius of curvature usable for the curved section to one specific radius of curvature, resulting in a restricted layout of the traveling rail.

Moreover, in the article conveying system including the overhead carrier, a mechanism for suspending an article may collide with the traveling rail on the outer track in the curved section depending on the shape of the mechanism. In other words, the mechanism moves over a large area on the outer track of the curved section and thus may collide with the traveling rail in the case that the traveling rail exists within the range of movement of the mechanism.

To prevent this problem, the traveling rail may not be provided on the outer track in a range where a collision may occur, so as to provide a section where the traveling rail is cut on the outer track.

In the section where the traveling rail is cut on the outer track, however, only the inner wheel comes into contact with the traveling rail. Thus, a starting torque needs to be obtained only by the inner wheel in preparation for stop of traveling of the overhead carrier in this section.

An object of the present invention is to provide an overhead carrier that can travel on curves with various curvatures so as to increase the layout flexibility of traveling rails, and obtain a torque for restart of the overhead carrier stopped in any section while preventing the mechanism of the overhead carrier from colliding with the traveling rail.

SUMMARY OF THE INVENTION

An article conveying system according to the present invention transports an article by means of an overhead carrier traveling along a transport track, the article conveying system including a pair of right and left traveling rails along the transport track on the ceiling of the article conveying system, the overhead carrier including driving wheels that are rotatably supported by the traveling rails in a drivable manner so as to move the overhead carrier along the traveling rails, and non-driving wheels that are rotated separately from the driving wheels, the overhead carrier having the driving wheels and the non-driving wheels on each of the right and left of a transport direction, the transport track including a linear section in which the driving wheels on right and left sides of the overhead carrier are respectively supported by the pair of right and left traveling rails, the transport track including a curved section in which the inner non-driving wheel of the overhead carrier is supported by the inner traveling rail while the outer driving wheel of the overhead carrier is supported by the outer traveling rail.

According to the article conveying system, the non-driving wheel is supported by the traveling rail on the inner track of the curved section while the driving wheel is supported by the traveling rail on the outer track of the curved section. This automatically adjusts the number of revolutions of the inner wheel (non-driving wheel) according to the number of revolutions of the outer wheel (driving wheel) and the curvature of the inner traveling rail. Thus, the right and left wheels of the overhead carrier can be different in the number of revolutions without complicated mechanisms such as a differential gear.

The article conveying system may be configured as follows: a portion of the curved section of the transport track includes an outer traveling-rail disconnected section where the outer traveling rail is disconnected, the overhead carrier includes auxiliary driving wheels provided on the right and left of the transport direction of the overhead carrier so as to rotate with the driving wheels, the auxiliary driving wheel having a smaller diameter than the driving wheel, and the inner auxiliary driving wheel of the overhead carrier is supported by the inner traveling rail in the outer traveling-rail disconnected section of the curved section of the transport track.

If the overhead carrier transports an article in a suspending manner, this configuration can prevent a mechanism for suspension of the overhead carrier from colliding with the outer traveling rail in the curved section. Additionally, in any one of the sections, the inner or outer driving wheel or the inner or outer auxiliary driving wheel is always supported by the traveling rail.

The article conveying system may be configured as follows: the driving wheel and the non-driving wheel have different diameters, and the pair of right and left traveling rails in the curved section of the transport track has steps on the surfaces of the traveling rails such that the inner traveling rail separates from the driving wheel while supporting the non-driving wheel and the outer traveling rail supports the driving wheel.

With this configuration, as the overhead carrier travels along the traveling rails, the driving wheels or the non-driving wheels to be supported by the traveling rails are automatically selected according to the shapes of the traveling rails.

The article conveying system may be configured as follows: In the configuration that the overhead carrier includes the auxiliary driving wheels, the driving wheel, the non-driving wheel, and the auxiliary driving wheel have different diameters, the pair of right and left traveling rails has steps on the surfaces of the traveling rails in portions of the curved section of the transport track other than the outer traveling-rail disconnected section such that the inner traveling rail separates from the driving wheel and the auxiliary driving wheel while supporting the non-driving wheel and the outer traveling rail separates from the auxiliary driving wheel while supporting the driving wheel, and the inner traveling rail in the outer traveling-rail disconnected section has the steps on the surface of the traveling rail such that the traveling rail separates from the driving wheel while supporting the auxiliary driving wheel.

With this configuration, as the overhead carrier travels along the traveling rails, ones to be supported by the traveling rails are automatically selected from the driving wheels, the non-driving wheels, and the auxiliary driving wheels according to the shapes of the traveling rails.

The article conveying system may be configured as follows: In the configuration that the overhead carrier includes the auxiliary driving wheels, the driving wheel, the non-driving wheel, and the auxiliary driving wheel have coaxial rotation axes, and the non-driving wheel is disposed between the driving wheel and the auxiliary driving wheel.

With this configuration, the additional auxiliary driving wheels are coaxially fixed to the driving wheels, and then the non-driving wheels are attached to the wheel shaft of the additional wheels via a bearing. Such a small alteration to an overhead carrier including only the driving wheels allows the provision of the overhead carrier having the non-driving wheels, the non-driving wheels, and the auxiliary driving wheels.

An overhead carrier according to the present invention travels along a pair of right and left traveling rails provided along a transport track on a ceiling of an article conveying system, the overhead carrier including driving wheels that are rotatably supported by the traveling rails in a drivable manner so as to move the overhead carrier along the traveling rails, and non-driving wheels that are rotated separately from the driving wheels, the driving and non-driving wheels being disposed on each of the right and left of a transport direction, the pair of right and left traveling rails supporting the respective driving wheels in a linear section of the transport track, the outer traveling rail only supporting the outer driving wheel in a curved section of the transport track, the inner traveling rail supporting the inner non-driving wheel in the curved section of the transport track.

According to this overhead carrier, the non-driving wheel is supported by the traveling rail on the inner track of the curved section while the driving wheel is supported by the traveling rail on the outer track. This automatically adjusts the number of revolutions of the inner non-driving wheel according to the number of revolutions of the outer driving wheel and the curvature of the inner traveling rail. Thus, the right and left wheels can be different in the number of revolutions without complicated mechanisms such as a differential gear.

According to the present invention, the right and left wheels can be different in the number of revolutions without complicated mechanisms, allowing the overhead carrier to smoothly travel on curves with any curvatures. Thus, the layout of the traveling rails, e.g., the route shape of the transport track can be relatively freely selected, increasing the design freedom of the article conveyor system.

The provision of the outer traveling-rail disconnected section prevents the mechanism of the overhead carrier from colliding with the traveling rail. Furthermore, in the outer traveling-rail disconnected section, the inner auxiliary driving wheel is supported by the traveling rail. Thus, even if the overhead carrier stops traveling in the outer traveling-rail disconnected section, a sufficient starting torque can be obtained by the auxiliary driving wheel supported by the traveling rail.

Moreover, ones to be supported by the traveling rails are automatically selected from the driving wheels, the non-driving wheels, and the auxiliary driving wheels according to the shapes of the traveling rails during the traveling of the overhead carrier. Thus, the wheels to be supported by the traveling rails can be switched without the need for a complicated mechanism for lifting the wheels.

Furthermore, the overhead carrier including the driving wheels, the non-driving wheels, and the auxiliary driving wheels can be obtained by only a small alteration to the overhead carrier only including the driving wheels. Thus, the present invention can be easily applied later to an existing article conveying system.

BRIEF DESCRIPTION OF THE DRAWINGS

FIG. 4A is a schematic front view of a linear section of the transport track, FIG. 4B is a schematic front view of a portion in the curved section of the transport track other than an outer traveling-rail disconnected section, and FIG. 4C is a schematic front view of the outer traveling-rail disconnected section of the transport track;

FIG. 5A is a schematic front view of the linear section of the transport track, FIG. 5B is a schematic front view of the portion in the curved section of the transport track other than the outer traveling-rail disconnected section, and FIG. 5C is a schematic front view of the outer traveling-rail disconnected section of the transport track; FIG. 6A shows an example of an auxiliary driving wheel near the body of the overhead carrier, and FIG. 6B shows an example of the non-driving wheel that is not coaxial with the driving wheel.

DETAILED DESCRIPTION OF THE PREFERRED EMBODIMENTS

Figure 1:
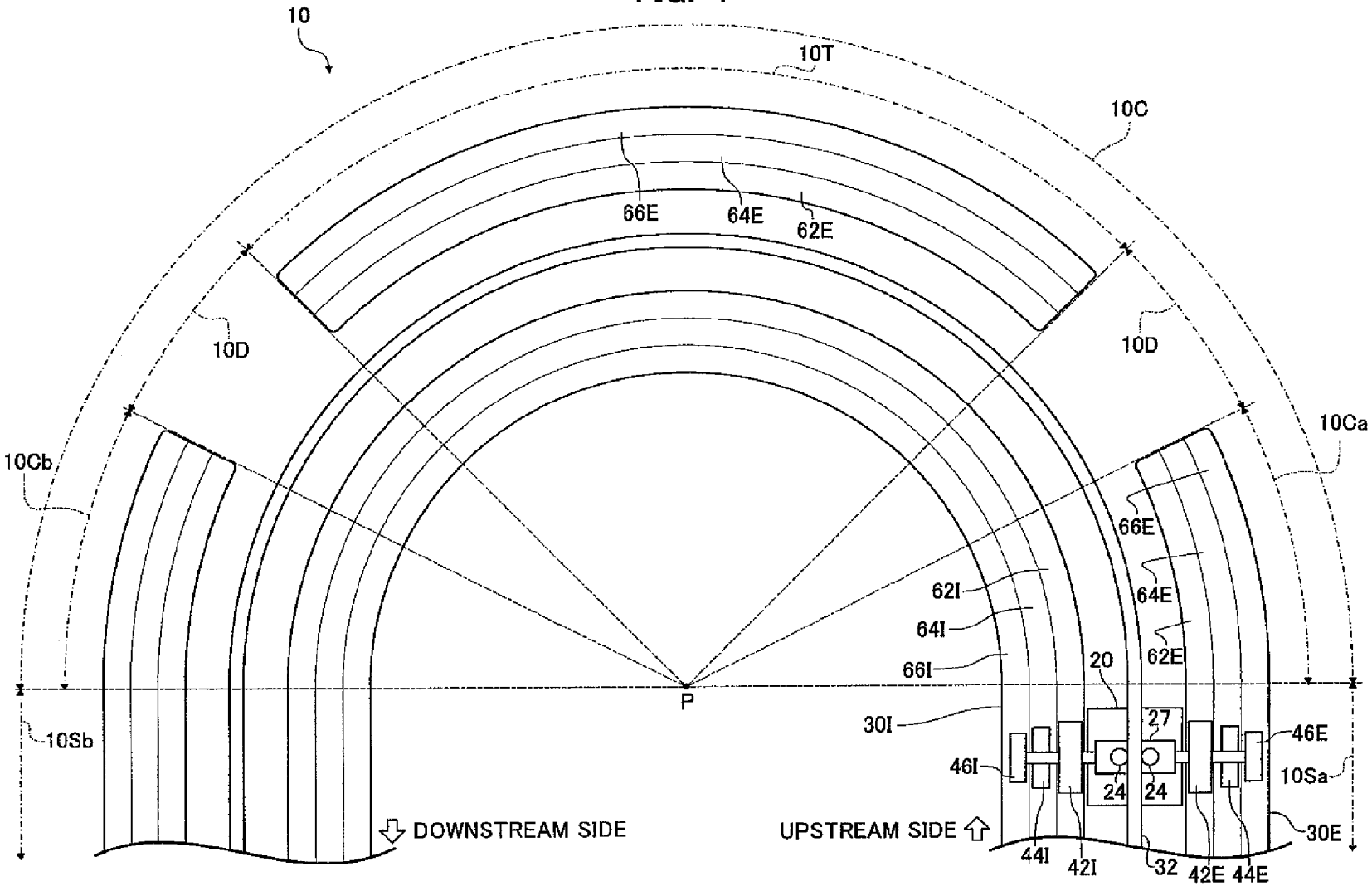
FIG. 1 is a schematic plan view showing the vicinity of a curved section of a transport track in an article conveying system according to an example of an embodiment of the present invention.

An example of an embodiment of the present invention will be described below in accordance with the accompanying drawings. For understanding of the configuration of the present invention, the shape and structure of each part are simplified in the drawings.

Transport Track

FIG. 1 is a plan view schematically showing a part of a transport track 10 where an article (e.g., a case accommodating multiple semiconductor devices) is transported in an article conveying system according to the present embodiment.

In the part of the transport track 10 shown in FIG. 1, an overhead carrier 20 with a suspended article travels into an upstream linear section 10Sa, passes through a curved section 10C, which is shaped like a letter U, counterclockwise with respect to a traveling direction, and then travels into a downstream linear section 10Sb.

The transport track 10 is provided with a pair of right and left traveling rails 30I and 30E on the ceiling of the article conveying system. The overhead carrier 20 travels along the traveling rails 30I and 30E. In this configuration, among the traveling rail 30I and the traveling rail 30E, the inner traveling rail 30I is provided on an inner track while the outer traveling rail 30E is provided on an outer track in the curved section 10C.

The outer traveling rail 30E is not provided in some portions (two portions in FIG. 1) in the curved section 10C. These portions serve as outer traveling-rail disconnected sections 10D where the outer traveling rail 30E is disconnected. The curved section 10C is divided by the outer traveling-rail disconnected sections 10D into an upstream curve entrance section 10Ca, a curve turning section 10T, and a downstream curve exit section 10Cb.

Overhead Carrier

Figure 2:
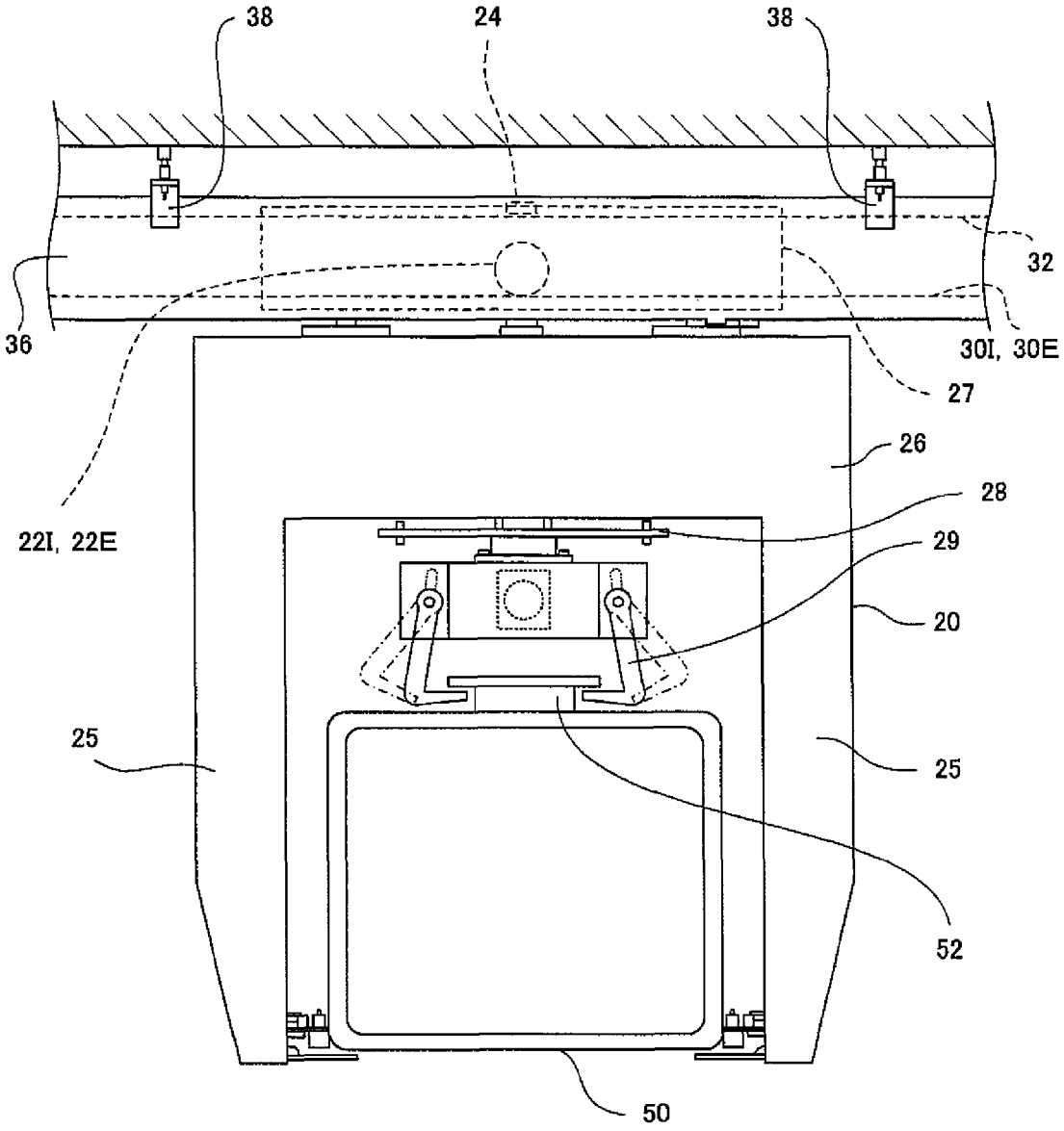
FIG. 2 is a side view schematically showing an overhead carrier used in the article conveying system.

FIG. 2 is a side view of the overhead carrier 20 used in the present embodiment. The overhead carrier 20 travels on the ceiling of the article conveying system. Vertical frame portions 25 extending downward are provided at the front and rear of the overhead carrier 20 in the traveling direction. A horizontal frame portion 26 disposed between the vertical frame portions 25 contains a holding portion 29 and a lift mechanism 28 that vertically moves the holding portion 29 by means such as winding up/loosening a wire (not shown). When an article 50 (e.g., a case accommodating multiple semiconductor devices) is located below the overhead carrier 20, the holding portion 29, which shown in FIG. 2 at a maximum possible height, can carry the article 50 upward by being moved downward by means of the lift mechanism 28, holding a suspension flange 52 of the article 50, and then being moved upward The horizontal frame portion 26 is connected to a traveling portion 27 provided above the horizontal frame portion 26. The overhead carrier 20 is caused to travel by traveling wheel units 22I and 22E and upper guide rollers 24 that are provided in the traveling portion 27.

The traveling wheel units 22I and 22E are supported on the faces of the traveling rails 30I and 30E that are provided in a rail cabinet 36 attached to the ceiling of the article conveying system via brackets 38. In this configuration, among the traveling wheel units 22I and 22E, the traveling wheel unit 22I supported by the inner traveling rail 30I is referred to as the inner traveling wheel unit 22I while the traveling wheel unit 22E supported by the outer traveling rail 30E is referred to as the outer traveling wheel unit 22E. The wheels of the traveling wheel units 22I and 22E are rotated while being supported by the traveling rails 30I and 30E, allowing the overhead carrier 20 to travel along the traveling rails 30I and 30E and transport the article 50 on the ceiling of the article conveying system.

An upper guide rail 32 is provided at the upper side of the rail cabinet 36. On the upper portion of the traveling portion 27 of the overhead carrier 20, the pair of right and left upper guide rollers 24 holds the upper guide rail 32 and is guided along the side surfaces of the upper guide rail 32, for preventing horizontal shaking of the overhead carrier 20. The posture of the overhead carrier 20 is kept thus by the upper guide rail 32 and the upper guide rollers 24.

Wheel Structure

Figure 3:
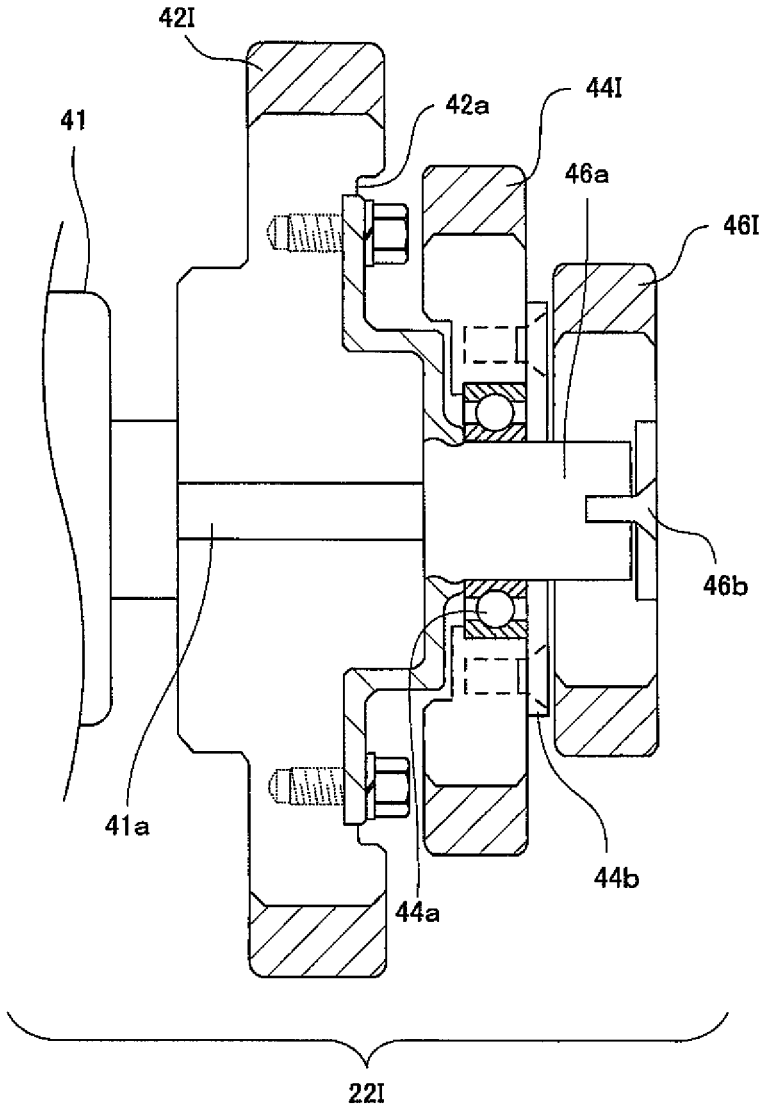
FIG. 3 is a cross-sectional view showing the wheel structure of the overhead carrier used in the article conveying system.

FIG. 3 shows the wheel structure of the traveling wheel units 22I and 22E that are provided on the right and left (inner and outer sides) of the transport direction (traveling direction) of the overhead carrier 20. The inner traveling wheel unit 22I will be described below. The outer traveling wheel unit 22E has a similar structure with the inner traveling wheel unit 22I. In the following explanation about the wheel structure, the wording "inner" is omitted.

The traveling wheel unit 22I includes three wheels: a driving wheel 42I, a non-driving wheel 44I, and an auxiliary driving wheel 46I.

The structure of the traveling wheel unit 22I will be described in an explanation about the steps for attaching the non-driving wheel 44I and the auxiliary driving wheel 46I into the traveling wheel unit 22I only provided with the driving wheel 42I.

The driving wheel 42I is directly fixed to a drive shaft 41*a* for transmitting a rotary force generated by a power mechanism 41, e.g., a motor, and thus the driving wheel 42I is rotated with the drive shaft 41*a*. The drive shaft 41*a* can be shared by the outer traveling wheel unit 22E.

In this state, an auxiliary driving wheel shaft 46*a* acting as the rotating shaft of the auxiliary driving wheel 46I is fixed to the driving wheel 42I. For example, as shown in FIG. 3, the flange of the auxiliary driving wheel shaft 46*a* may be fixed into a concave portion 42*a* of the driving wheel 42I with screws or the like.

The non-driving wheel 44I is attached before the auxiliary driving wheel 46I is attached to the auxiliary driving wheel shaft 46*a*. In the structure of FIG. 3, the auxiliary driving wheel shaft 46*a* is passed through the shaft hole of the non-driving wheel 44I borne by a non-driving wheel bearing 44*a*, and then an assistant plate 44*b* having a through hole for insertion of the auxiliary driving wheel shaft 46*a* is laid and screwed onto the non-driving wheel 44I. Thus, the non-driving wheel 44I is rotatably attached to the auxiliary driving wheel shaft 46*a*.

After the non-driving wheel 44I is attached, the auxiliary driving wheel 46I is attached to the distal end of the auxiliary driving wheel shaft 46*a*. In the structure of FIG. 3, the auxiliary driving wheel 46I is fixed to the auxiliary driving wheel shaft 46*a* with an auxiliary driving-wheel fixing screw 46*b* into a screw hole provided on the distal end of the auxiliary driving wheel shaft 46*a*.

With this configuration, the auxiliary driving wheel 46I is rotated with the driving wheel 42I by a rotary force from the power mechanism 41, whereas the non-driving wheel 44I is rotated separately from the driving wheel 42I and the auxiliary driving wheel 46I without being affected by the rotations of the driving wheel 42I and the auxiliary driving wheel 46I. In this configuration, the rotation axes of the driving wheel 42I, the non-driving wheel 44I, and the auxiliary driving wheel 46I are coaxial to one another and the non-driving wheel 44I is disposed between the driving wheel 42I and the auxiliary driving wheel 46I.

In the structure of FIG. 3, among the driving wheel 42I, the non-driving wheel 44I and the auxiliary driving wheel 46I, the driving wheel 42I has the largest diameter, the non-driving wheel 44I has the second largest diameter, and the auxiliary driving wheel 46I has the smallest diameter among these three wheels.

Traveling Rail

Figure 4A:
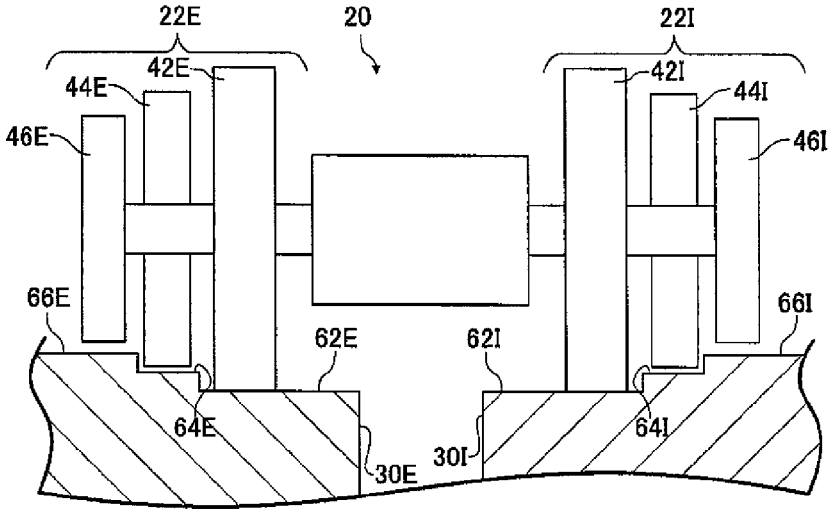
FIGS. 4A to 4C schematically show the shapes of the overhead carrier viewed from a traveling direction in the article conveying system.
Figure 4B:
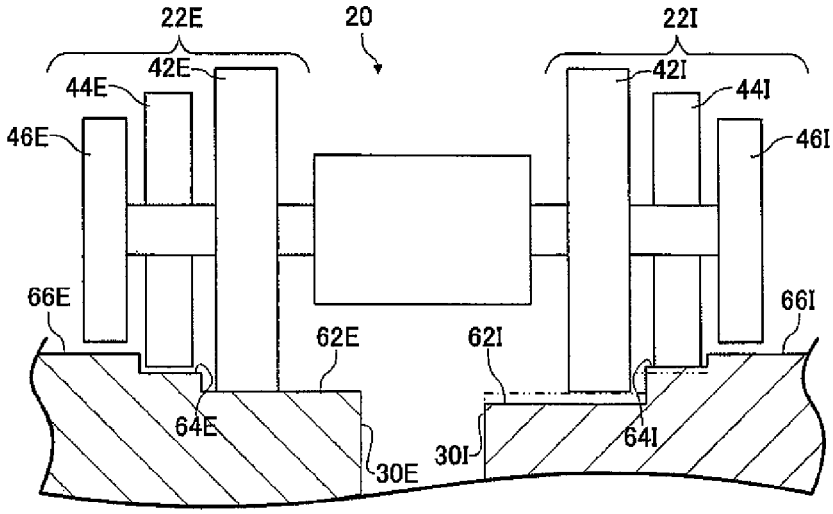
Figure 4C:
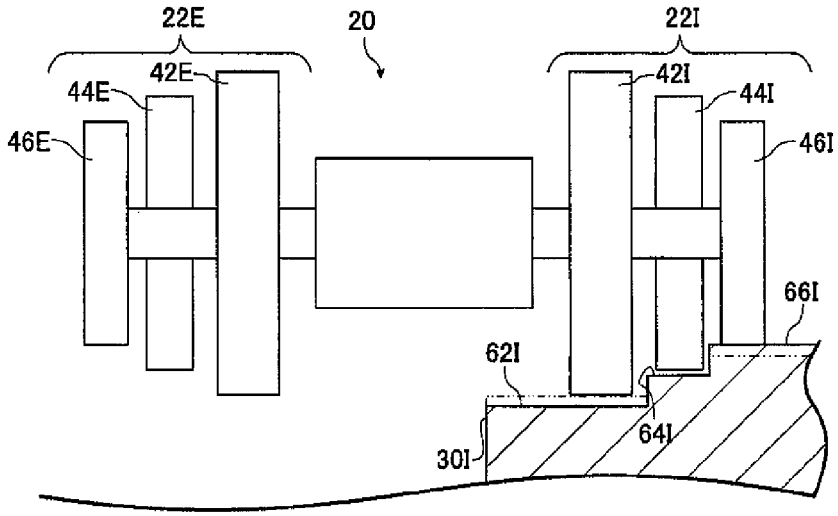

In the region of FIG. 1, the traveling rails 30I and 30E are each entirely shaped like a letter U (forming a U-turn). As shown in FIGS. 4A, 4B, and 4C, the surfaces of the traveling rails 30I and 30E each have three steps with different heights. Specifically, the traveling rails 30I and 30E have driving wheel steps 62I and 62E, non-driving wheel steps 64I and 64E, and auxiliary driving wheel steps 66I and 66E.

Regarding the letters at the ends of the reference numerals of the steps, "I" denotes parts of the inner traveling rail 30I while "E" denotes parts of the outer traveling rail 30E. For example, the driving wheel step 62I is formed on the inner traveling rail 30I while the driving wheel step 62E is formed on the outer traveling rail 30E.

FIGS. 4A, 4B, and 4C schematically show the shape of the overhead carrier 20 as viewed from the traveling direction on the transport track 10 shown in FIG. 1. In FIGS. 4A, 4B, and 4C, the inner track is shown on the right side while the outer track is shown on the left side. In FIG. 4, for understanding of the relationship between the wheels of the over head carrier 20 and the traveling rails 30I and 30E, portions other than the traveling wheel units 22I and 22E of the overhead carrier 20 are omitted (the vertical frame portion 25, the upper guide roller 24, and so on in FIG. 2 are omitted).

These steps are provided with corresponding to the wheels constituting the traveling wheel units 22I and 22E of the overhead carrier 20, that is, the driving wheel 42I and a driving wheel 42E, the non-driving wheel 44I and a non-driving wheel 44E, and the auxiliary driving wheel 46I and an auxiliary driving wheel 46E. Specifically, as shown in FIGS. 4A, 4B, and 4C, the driving wheel steps 62I and 62E are provided under the respective driving wheels 42I and 42E, the non-driving wheel steps 64I and 64E are provided under the respective non-driving wheels 44I and 44E, and the auxiliary driving wheel steps 66I and 66E are provided under the respective auxiliary driving wheels 46I and 46E.

These step increase in height as the corresponding wheels decrease in diameter. In the structure of FIGS. 4A, 4B, and 4C, the auxiliary driving wheel steps 66I and 66E corresponding to the auxiliary driving wheel 46I having the smallest diameter are the highest among the steps, the non-driving wheel steps 64I and 64E are the second highest, and the driving wheel steps 62I and 62E are the lowest among the steps.

These steps are not consistently kept at a constant height over the whole of the transport track 10 shown in FIG. 1 but slightly fluctuate in height depending on the section. Specifically, the heights of the steps are adjusted so as to support only the wheels to be supported in the section and separate from the wheels not to be supported in the section.

For example, on the transport track 10 shown in FIG. 1, in sections where the overhead carrier 20 linearly travels, that is, in the upstream linear section 10Sa and the downstream linear section 10Sb, the top surfaces of the inner/outer driving wheel steps 62I and 62E are so high as to support the inner/outer driving wheels 42I and 42E that are in contact with the driving wheel steps 62I and 62E as shown in FIG. 4A. In contrast, the non-driving wheel steps 64I and 64E and the auxiliary driving wheel steps 66I and 66E are all slightly lower than the bottoms of the non-driving wheels 44I and 44E and the auxiliary driving wheels 46I and 46E such that the wheel steps are not in contact with the wheels. In other words, in these sections, the traveling rails 30I and 30E are shaped so as to separate from the non-driving wheels 44I and 44E and the auxiliary driving wheels 46I and 46E while supporting the driving wheels 42I and 42E.

In the curved section 10C of the transport track 10 shown in FIG. 1, portions other than the outer traveling-rail disconnected sections 10D, that is, the upstream curve entrance section 10Ca, the curve turning section 10T, and the downstream curve exit section 10Cb include, as shown in FIG. 4B, the outer traveling rail 30E supporting the outer driving wheel 42E and the inner traveling rail 30I supporting the inner non-driving wheel 44I. Specifically, the outer traveling rail 30E is identical in shape to that of FIG. 4A, whereas the inner traveling rail 30I has the driving wheel step 62I that is slightly lower than that of FIG. 4A so as to separate from the driving wheel 42I and has the non-driving wheel step 64I that is slightly higher than that of FIG. 4A so as to support the non-driving wheel 44I. The auxiliary driving wheel step 66I is as high as that of FIG. 4A.

Furthermore, in the outer traveling-rail disconnected sections 10D of the transport track 10 shown in FIG. 1, as shown in FIG. 4C, any one of the wheels is not supported on the outer track but the auxiliary driving wheel 46I is supported on the inner track. Specifically, on the outer track, the outer traveling rail 30E is disconnected in these sections and thus any one of the wheels of the outer traveling wheel unit 22E is not supported, whereas on the inner track, the inner traveling rail 30I is shaped such that the driving wheel step 62I is slightly lower than that of FIG. 4A so as to separate from the driving wheel 42I and the auxiliary driving wheel step 66I is slightly higher than that of FIG. 4A so as to support the auxiliary driving wheel 46I.

For the provision of the steps formed thus on the surfaces of the rails, it is preferably identified which wheels should be supported in which sections on the traveling rails 30I and 30E based on the route shape of the transport track 10 (FIG. 1) set in the article conveying system (the layout of the traveling rails 30I and 30E).

In the sections where the auxiliary driving wheel 46I is supported on the inner track, that is, in ranges corresponding to the outer traveling-rail disconnected sections 10D on the inner traveling rail 30I, in particular, the ranges of the passage of the inner traveling wheel unit 22I on the inner traveling rail 30I during the passage of the overhead carrier 20 through the outer traveling-rail disconnected sections 10D may be identified for determining the shape of the surfaces of the inner traveling rail 30I so as to support the auxiliary driving wheel 46I in the identified ranges. For example, in the layout of FIG. 1, the surfaces of the inner traveling rail 30I may be formed such that the auxiliary driving wheel 46I is supported in the range between the intersection points of the inner traveling rail 30I and two straight lines that connect the starting point and the endpoint of the outer traveling-rail disconnected section 10D to a center point P of the radius of curvature of the curved section 10C.

The range in which the outer traveling-rail disconnected section 10D is provided may be set such that the mechanism of the overhead carrier 20 does not collide with the outer traveling rail 30E. Such range can be identified based on the curvature of the overall curved section 10C and the diameters of the driving wheels 42I and 42E and the auxiliary driving wheels 46I and 46E.

Behaviors of the Overhead Carrier

Referring to FIG. 1 and FIGS. 4A, 4B, and 4C, the behaviors of the overhead carrier 20 traveling along the traveling rails 30I and 30E will be described below.

Traveling in the Upstream Linear Section (Traveling in a Linear Section)

The overhead carrier 20 enters the range of FIG. 1 through the upstream linear section 10Sa. In this section, as shown in FIG. 4A, the inner driving wheel 42I and the outer driving wheel 42E are respectively supported by the driving wheel step 62I of the inner traveling rail 30I and the driving wheel step 62E of the outer traveling rail 30E.

If the inner/outer driving wheel steps 62I and 62E are set at the same height and the inner/outer driving wheels 42I and 42E are coaxial with the same diameter, the overhead carrier 20 moves at the same speed on the right and left of the vehicle body of the overhead carrier 20 with respect to the transport direction. Thus, the overhead carrier 20 can stably move in this section.

Traveling in the Upstream Curve Entrance Section (Traveling in Portions in the Curved Section Other than the Outer Traveling-Rail Disconnected Section)

The overhead carrier 20 approaching the curved section 10C first travels into the upstream curve entrance section 10Ca. In this section, as shown in FIG. 4B, the inner non-driving wheel 44I is supported by the non-driving wheel step 64I of the inner traveling rail 30I while the outer driving wheel 42E is supported by the outer driving wheel step 62E.

The inner non-driving wheel 44I is rotated separately from the inner driving wheel 42I. Thus, even if the inner driving wheel 42I and the outer driving wheel 42E have the common drive shaft, the inner non-driving wheel 44I does not rotate with the same speed as the outer driving wheel 42E. The rotation speed of the inner non-driving wheel 44I corresponds to the advance rate of the overall overhead carrier 20 entailed by the rotation of the outer driving wheel 42E supported on the outer traveling rail 30E and the curvature of the inner traveling rail 30I in this section.

Traveling in the Outer Traveling-Rail Disconnected Section

When the traveling overhead carrier 20 reaches the outer traveling-rail disconnected section 10D, as shown in FIG. 4C, any of the wheels of the outer traveling wheel unit 22I are not supported and the inner auxiliary driving wheel 46I is supported by the auxiliary driving wheel step 66I of the inner traveling rail 30I. In this state, the auxiliary driving wheel 46I supported on the auxiliary driving wheel step 66I of the inner traveling rail 30I is rotated so as to advance the overhead carrier 20.

In this case, if the inner auxiliary driving wheel 46I has the same diameter as the outer driving wheel 42E and the number of revolutions of the wheels is kept constant in the upstream curve entrance section 10Ca and the outer traveling-rail disconnected sections 10D, the angular speed of the overhead carrier 20 with respect to the center point P of the radius of curvature of the curved section 10C rapidly increases when the overhead carrier 20 enters the outer traveling-rail disconnected section 10D because the inner traveling rail 30I and the outer traveling rail 30E have different curvatures (the inner traveling rail 30I has a larger curvature) in the curved section 10C.

However, if the inner auxiliary driving wheel 46I has a smaller diameter than the outer driving wheel 42E, the travel distance by one rotation of the inner auxiliary driving wheel 46I is shorter than that of the outer driving wheel 42E. Thus, even if the overhead carrier 20 enters the outer traveling-rail disconnected section 10D with the same number of revolutions as in the upstream curve entrance section 10Ca, the overhead carrier 20 does not need to rapidly increase in angular speed.

The diameter ratios between the driving wheels 42I and 42E and the auxiliary driving wheels 46I and 46E may be selected such that even if the number of revolutions of the wheels is kept constant, the angular speed of the overhead carrier 20 does not vary between the portions of the curved section 10C other than the outer traveling-rail disconnected sections 10D (sections where the overhead carrier 20 is moved forward by the outer driving wheel 42E) and the outer traveling-rail disconnected sections 10D (sections where the overhead carrier 20 is moved forward by the inner auxiliary driving wheel 46I).

In this section, the outer traveling wheel unit 22E is not supported. Also in this state, the upper guide rail 32 and the upper guide rollers 24 (not shown in FIG. 4) in FIG. 2 keep the posture of the overhead carrier 20 (keep in a horizontal position), preventing the overhead carrier 20 from falling from the ceiling.

Traveling from the Curve Turning Section to the Downstream Linear Section

When the overhead carrier 20 enters the curve turning section 10T through the outer traveling-rail disconnected section 10D in FIG. 1, as in the upstream curve entrance section 10Ca, the non-driving wheel 44I is supported on the inner track while the driving wheel 42E is supported on the outer track. Also in this section, the rotation speed of the non-driving wheel 44I is determined according to the advance rate of the overall overhead carrier 20 and the curvature of the inner traveling rail 30I.

The overhead carrier 20 having passed through the curve turning section 10T enters the other outer traveling-rail disconnected section 10D. In this section, the outer traveling wheel unit 22E is not supported and the auxiliary driving wheel 46I is supported on the inner track.

The overhead carrier 20 having passed through the other outer traveling-rail disconnected section 10D reaches the downstream curve exit section 10Cb. In this section, as in the upstream curve entrance section 10Ca and the curve turning section 10T, the non-driving wheel 44I is supported on the inner track while the driving wheel 42E is supported on the outer track.

After the overhead carrier 20 moves out of the curved section 10C through the downstream curve exit section 10Cb, the overhead carrier 20 passes through the downstream linear section 10Sb and advances to the further downstream side of the transport track 10. In this section, the inner and outer driving wheels 42I and 42E are supported as in the upstream linear section 10Sa.

As has been discussed, according to the present embodiment, the number of revolutions (rotation speed) of the inner non-driving wheel 44I supported by the inner traveling rail 30I is automatically adjusted according to the number of revolutions of the outer driving wheel 42E supported by the outer traveling rail 30E and the curvature of the inner traveling rail 30I, in the portions of the curved section 10C of the transport track 10 other than the outer traveling-rail disconnected sections 10D (the upstream curve entrance section 10Ca, the curve turning section 10T, and the downstream curve exit section 10Cb). Thus, the right and left wheels (the inner and outer wheels) of the overhead carrier 20 can be different in the number of revolutions without complicated mechanisms such as a differential gear, allowing the overhead carrier 20 to smoothly travel on curves with any curvatures. Thus, the route shape of the transport track 10 (the layout of the traveling rails 30I and 30E) can be relatively freely selected, increasing the design freedom of the article conveying system.

According to the present embodiment, the driving wheels 42I and 42E, the non-driving wheels 44I and 44E, and the auxiliary driving wheels 46I and 46E are provided on each of the right and left of the transport direction (traveling direction) of the overhead carrier 20. Thus, the overhead carrier 20 can travel in a curve turning to the right as smoothly as in the curved section 10C turning to the left with respect to the traveling direction as described above. In a curve to the right, the inner constituent elements described above and the outer constituent elements are replaced with each other.

Moreover, according to the present embodiment, the provision of the outer traveling-rail disconnected sections 10D prevents the mechanism of the overhead carrier 20 from colliding with the outer traveling rail 30E in the curved section 10C. Furthermore, in the outer traveling-rail disconnected section 10D, the inner auxiliary driving wheel 46I is supported by the inner traveling rail 30I. Thus, even if the overhead carrier 20 stops traveling in the outer traveling-rail disconnected section 10 in response to emergency stop of transportation, a sufficient restart torque can be obtained by the inner auxiliary driving wheel 46I rotated by a driving force.

Furthermore, according to the present embodiment, ones to be supported by the traveling rails 30I and 30E are automatically selected from the driving wheels 42I and 42E, the non-driving wheels 44I and 44E, and the auxiliary driving wheels 46I and 46E according to the shapes of the traveling rails 30I and 30E during the traveling of the overhead carrier 20. Thus, the wheels to be supported by the traveling rails can be switched without the need for a complicated mechanism for lifting the wheels.

Moreover, according to the present embodiment, the additional auxiliary driving wheels 46I and 46E are coaxially fixed to the driving wheels 42I and 42E that are rotated by a driving force, and then the non-driving wheels 44I and 44E are attached to the auxiliary driving wheel shaft 46*a* (FIG. 3) of the additional auxiliary driving wheels 46I and 46E via the non-driving wheel bearing 44*a*. Such a small alteration to the overhead carrier 20 including only the driving wheels 42I and 42E allows the provision of the non-driving wheels 44I and 44E and the auxiliary driving wheels 46I and 46E. Thus, this structure can be easily applied later to the overhead carrier 20 provided in an existing article conveying system.

Modification

In the present embodiment, the outer traveling-rail disconnected section 10D is provided to prevent the mechanism of the overhead carrier 20 for transporting (suspending) articles from colliding with the outer traveling rail 30E. The rail disconnected section 10D may not be provided as long as the mechanism is not shaped to collide with the outer traveling rail 30E. In this case, the inner non-driving wheel 44I may be supported by the inner rail 30I over the whole of the curved section 10C, and thus the auxiliary driving wheels 46I and 46E and the auxiliary driving wheel steps 66I and 66E may not be provided. In this case, the curvature of the overall curved section 10C can be freely selected, further increasing the design freedom of the article conveying system.

Figure 5A:
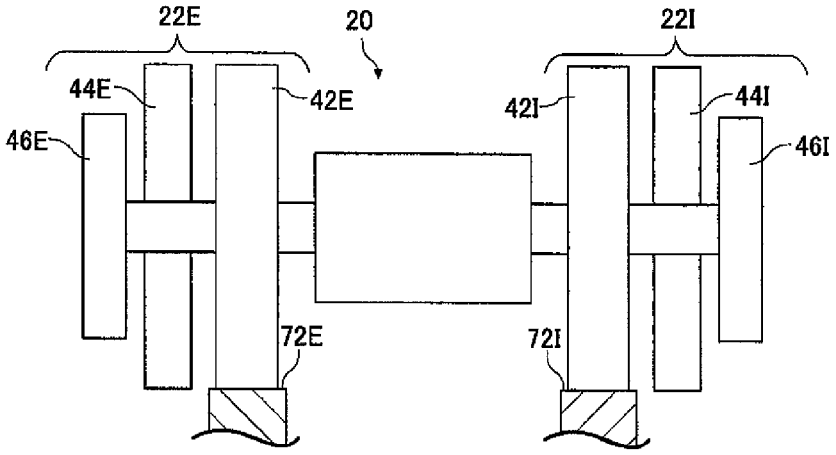
FIGS. 5A to 5C schematically show the shapes of the overhead carrier viewed from the traveling direction if a non-driving wheel is identical in diameter to a driving wheel according to a modification of the embodiment of the present invention.
Figure 5B:
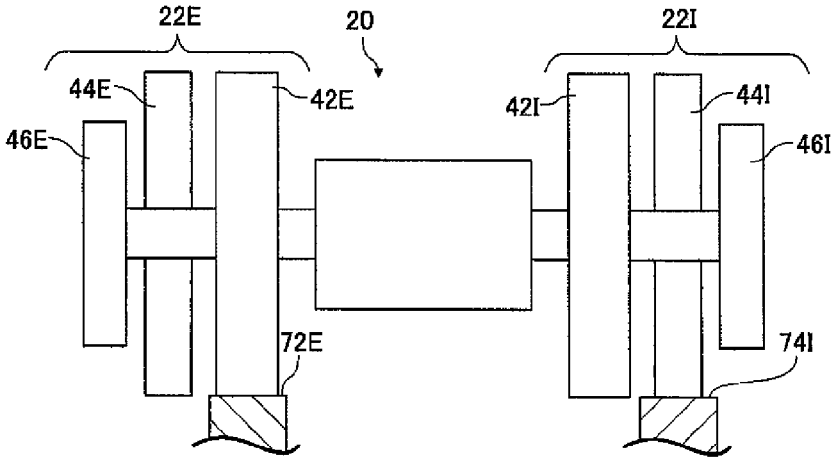
Figure 5C:
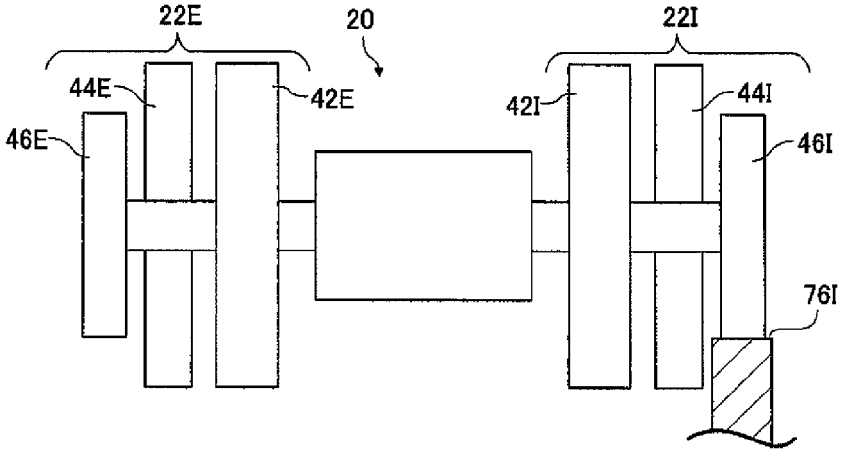

In the present embodiment, the non-driving wheels 44I and 44E are smaller in diameter than the driving wheels 42I and 42E. The non-driving wheels 44I and 44E may be identical in diameter to the driving wheels 42I and 42E. In this case, only the rails for the supported wheels may be provided as shown in FIGS. 5A, 5B, and 5C instead of the steps provided on the surfaces of the traveling rails 30I and 30E as shown in FIGS. 4A, 4B, and 4C. Specifically, in the section where the overhead carrier 20 linearly travels, as shown in FIG. 5A, the driving wheels 42I and 42E are supported by an inner driving wheel rail 72I and an outer driving wheel rail 72E respectively provided under the inner driving wheel 42I and the outer driving wheel 42E, the driving wheel rails 72I and 72E having a small rail width that supports only the driving wheels 42I and 42E. No rails are provided under the non-driving wheels 44I and 44E and the auxiliary driving wheels 46I and 46E. In the portions of the curved section 10C other than the outer traveling-rail disconnected sections 10D, as shown in FIG. 5B, the outer driving wheel 42E is supported by the outer driving wheel rail 72E on the outer track while on the inner track the non-driving wheel 44I is supported by an inner non-driving wheel rail 74I instead of the inner driving wheel rail 72I, the inner non-driving wheel rail 74I having a small rail width that supports only the non-driving wheel 44I. As shown in FIG. 5C, on the inner track of the outer traveling-rail disconnected section 10D, the auxiliary driving wheel 46I is supported by an inner auxiliary driving wheel rail 76I having a small rail width that supports only the auxiliary driving wheel 46I. This configuration can achieve a smaller rail width than the traveling rails 30I and 30E shown in FIGS. 4A to 4C, reducing the need for facility construction materials.

Figure 6A:
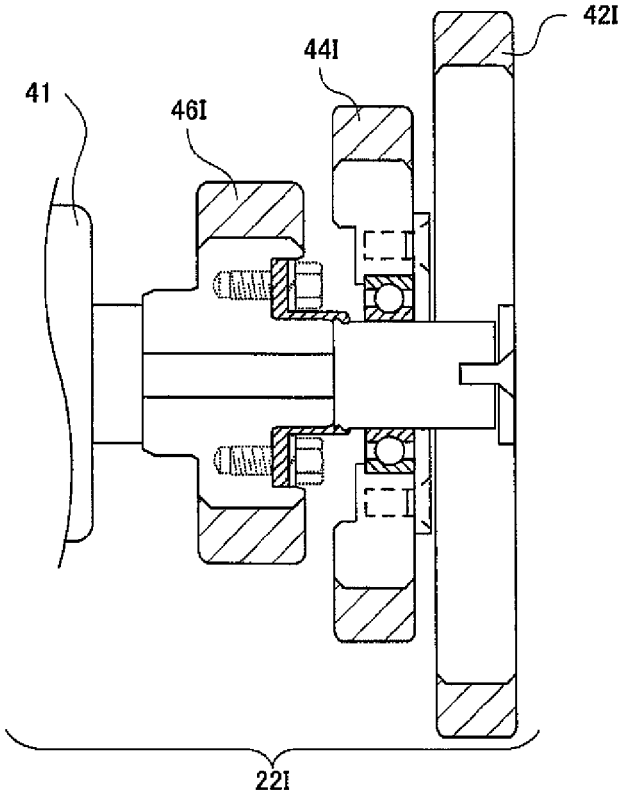
FIGS. 6A and 6B are cross-sectional views of the wheel structure of the overhead carrier according to a modification of the embodiment of the present invention.

As shown in FIG. 3, in the present embodiment, the driving wheel 42I, the non-driving wheel 44I, and the auxiliary driving wheel 46I are sequentially disposed from the body to the outside of the overhead carrier 20. The order of the disposed wheels is not limited. For example, as shown in FIG. 6A, the auxiliary driving wheel 46I, the non-driving wheel 44I, and the driving wheel 42I may be sequentially disposed from the body to the outside of the overhead carrier 20. Although the wheels on the inner track are described, the order of the outer wheels may be also changed. The surfaces of the traveling rails 30I and 30E need to be shaped according to the layout of the wheels.

Figure 6B:
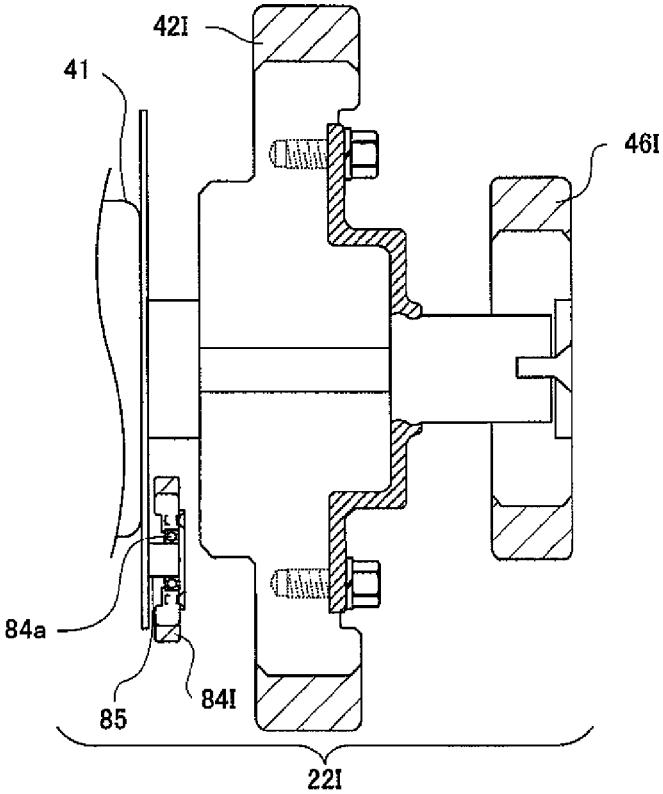

In the present embodiment, as shown in FIG. 3, the non-driving wheel 44I is coaxial with the driving wheel 42I. The non-driving wheel 44I only needs to be rotated separately from the driving wheel 42I. The wheel shaft of the non-driving wheel 44I does not need to be coaxial with that of the driving wheel 42I. For example, as shown in FIG. 6B, a non-driving wheel shaft 85 may be fixed to the flange (not rotating) of the power mechanism 41, and then a small non-driving wheel 841 may be attached to the non-driving wheel shaft 85 via a non-driving wheel bearing 84*a*.

Having described the invention, the following is claimed:

1. An article conveying system that transports an article by means of an overhead carrier traveling along a transport track, the article conveying system including a pair of outer and inner traveling rails along the transport track on a ceiling of the article conveying system, the overhead carrier including outer and inner driving wheels that are rotatably supported by the outer and inner traveling rails in a drivable manner so as to move the overhead carrier along the outer and inner traveling rails, and outer and inner non-driving wheels that are rotated separately from the outer and inner driving wheels, the overhead carrier having the outer and inner driving wheels and the outer and inner non-driving wheels on each of left and right of a transport direction, respectively, the transport track including a linear section in which the outer and inner driving wheels on left and right sides of the overhead carrier are respectively supported by the pair of outer and inner traveling rails, the transport track including a curved section in which the inner non-driving wheel of the overhead carrier is supported by the inner traveling rail while the outer driving wheel of the overhead carrier is supported by the outer traveling rail.

2. The article conveying system according to claim 1, wherein a portion of the curved section of the transport track includes an outer traveling-rail disconnected section where the outer traveling rail is disconnected, the overhead carrier includes outer and inner auxiliary driving wheels provided on the left and right of the transport direction of the overhead carrier so as to rotate with the outer and inner driving wheels, the outer and inner auxiliary driving wheels having a smaller diameter than the outer and inner driving wheels, and the inner auxiliary driving wheel of the overhead carrier is supported by the inner traveling rail in corresponding with the outer traveling-rail disconnected section of the curved section of the transport track.

3. The article conveying system according to claim 1, wherein the outer and inner driving wheels and the outer and inner non-driving wheels have different diameters, respectively, and the pair of outer and inner traveling rails in the curved section of the transport track has steps on surfaces of the outer and inner traveling rails such that the inner traveling rail separates from the inner driving wheel while supporting the inner non-driving wheel and the outer traveling rail supports the outer driving wheel.

4. The article conveying system according to claim 2, wherein the outer and inner driving wheels, the outer and inner non-driving wheels, and the outer and inner auxiliary driving wheels have different diameters, respectively, the pair of outer and inner traveling rails has steps on surfaces of the outer and inner traveling rails in portions of the curved section of the transport track other than the outer traveling-rail disconnected section such that the inner traveling rail separates from the inner driving wheel and the inner auxiliary driving wheel while supporting the inner non-driving wheel and the outer traveling rail separates from the outer auxiliary driving wheel while supporting the outer driving wheel, and the inner traveling rail, while corresponding with the outer traveling-rail disconnected section, has the steps on the surface of the inner traveling rail such that the inner traveling rail separates from the inner driving wheel while supporting the inner auxiliary driving wheel.

5. The article conveying system according to claim 2, wherein the outer and inner driving wheels, the outer and inner non-driving wheels, and the outer and inner auxiliary driving wheels have coaxial rotation axes, respectively, and the outer and inner non-driving wheels are respectively disposed between the outer and inner driving wheels and the outer and inner auxiliary driving wheels.

6. An overhead carrier that travels along a pair of outer and inner traveling rails provided along a transport track on a ceiling of an article conveying system, the overhead carrier including outer and inner driving wheels that are rotatably supported by the outer and inner traveling rails in a drivable manner so as to move the overhead carrier along the outer and inner traveling rails, and outer and inner non-driving wheels that are rotated separately from the outer and inner driving wheels, the outer and inner driving and non-driving wheels being respectively disposed on each of left and right of a transport direction, the pair of outer and inner traveling rails supporting the respective outer and inner driving wheels in a linear section of the transport track, the outer traveling rail only supporting the outer driving wheel in a curved section of the transport track, the inner traveling rail supporting the inner non-driving wheel in the curved section of the transport track.

* * * * *